United States Patent [19]

Kanada et al.

[11] 4,163,669

[45] Aug. 7, 1979

[54] MULTILAYER SILVER HALIDE COLOR PHOTOGRAPHIC MATERIAL

[75] Inventors: Eiji Kanada; Noboru Itoh; Hiroshi Ikeda; Tamotsu Iwata, all of Nagaokakyo, Japan

[73] Assignee: Mitsubishi Paper Mills, Ltd., Tokyo, Japan

[21] Appl. No.: 891,925

[22] Filed: Mar. 30, 1978

[30] Foreign Application Priority Data

Apr. 27, 1977 [JP] Japan ..... 52-48945

[51] Int. Cl.[2] ..... G03C 1/76; G03C 1/06; G03C 1/34; G03C 1/30

[52] U.S. Cl. ..... 96/74; 96/95; 96/109; 96/110; 96/76 R

[58] Field of Search ..... 96/95, 109, 110, 74, 96/76

[56] References Cited

U.S. PATENT DOCUMENTS

| | | | |
|---|---|---|---|
| 2,432,865 | 12/1947 | Dimsdale et al. | 96/110 |
| 2,552,229 | 5/1951 | Stauffer et al. | 96/110 |
| 2,597,856 | 5/1952 | Damschroder | 96/110 |
| 2,597,915 | 5/1952 | Yutzy et al. | 96/110 |
| 2,915,395 | 12/1959 | Popeck et al. | 96/109 |
| 3,155,507 | 11/1964 | Blake | 96/95 |
| 3,282,694 | 11/1966 | Luckey | 96/95 |
| 3,295,978 | 1/1967 | Barr | 96/95 |
| 3,536,492 | 10/1970 | Luchs | 96/110 |
| 3,639,128 | 2/1972 | Matejec et al. | 96/109 |
| 3,647,439 | 3/1972 | Bass | 96/95 |
| 3,672,903 | 6/1972 | Chang | 96/110 |
| 3,719,492 | 3/1973 | Barr et al. | 96/95 |
| 3,847,619 | 11/1974 | Bissonetle et al. | 96/110 |
| 3,883,350 | 5/1975 | Charkoudian | 96/110 |
| 3,901,711 | 8/1975 | Iwaosa et al. | 96/95 |
| 4,013,470 | 3/1977 | Landon | 96/95 |
| 4,076,534 | 2/1978 | Noguchi et al. | 96/95 |

*Primary Examiner*—Mary F. Kelley
*Attorney, Agent, or Firm*—Cushman, Darby & Cushman

[57] ABSTRACT

A multilayer silver halide color photographic material submissive to rapid silver removal containing, in at least one layer, a salt of at least one compound selected from the group consisting of organic compounds containing sulfur such as, for example, mercaptotriazoles and the like and heterocyclic compounds containing no sulfur such as, for example, imidazole compounds and the like with at least one heavy metal ion such as, for example, ions of silver, zinc, cobalt and the like.

8 Claims, No Drawings

MULTILAYER SILVER HALIDE COLOR PHOTOGRAPHIC MATERIAL

BACKGROUND OF THE INVENTION

This invention relates to color photographic sensitive materials suitable for rapid photographic processing. More particularly, it relates to silver halide color photographic sensitive materials improved in the speed of silver removal by bleaching and fixing (hereinafter referred to simply as "silver removal").

Subsequent to the imagewise exposure of the silver halide color photographic sensitive material, fundamental photographic processing steps to reproduce the image on the photographic material are the color developing step and the silver removing step. In the color developing step, silver halide in the exposed silver halide color photographic sensitive material is reduced to silver by the color developing agent and at the same time the oxidized color developing agent reacts with a color forming agent (coupler) to produce a dye image. Thereafter, the color photographic material undergoes silver removing treatment in the next step in which the silver formed in the preceding step is oxidized by an oxidizing agent (commonly called bleaching agent) and then removed from the photographic material by dissolution by the action of a silver ion complexing agent (commonly called fixing agent), leaving behind a dye image on the photographic material. In the actual photographic processing, the fundamental steps of color development and silver removal are accompanied with other auxiliary steps to maintain photographic and physical qualities of the image or to improve preservability of the image such as, for example, hardening bath to prevent the emulsion layer from becoming too soft during the treatment, stop bath to terminate quickly the developing reaction, stabilizing bath to stabilize the image, and stripping bath to remove the backing coat from the support.

In a procedure now practically employed in the silver removing step, the silver image is oxidized to silver halide in a treating solution containing a ferricyanide as major ingredient and the resulting silver halide is transformed into soluble form in a fixing bath containing sodium or ammonium thiosulfate as major ingredient, whereby it is removed by dissolution in water. The former treating procedure utilizing a ferricyanide as major reactant, although generally powerful in silver removing ability, has disadvantages of requiring two baths and frequently a special construction material for the treating equipment on account of the highly corrosive nature of the ferricyanide. Further, the former procedure has another disadvantage of being liable to stain formation when used in treating print paper and a defect of giving rise to environmental pollution, resulting in serious public hazard.

In order to alleviate the above difficulties, a treating solution containing ferric salt of an aminopolycarboxylic acid has been widely used. The problem in this case is a relatively weak silver removing power which necessitates the use of a large amount of an expensive iron salt of aminopolycarboxylic acid. To overcome the difficulty, the iron salt of an aminopolycarboxylic acid has been used cojointly with a so-called bleach accelerator. Examples of widely known bleach accelerators include thiourea described in Swiss Pat. No. 336,257, thiourea derivatives in Japanese Patent Publication No. 8,506/70, polyoxyethylene compounds in German Pat. No. 966,410, iodine compounds in German Pat. No. 1,127,715, heterocyclic compounds in German Pat. No. 1,290,812, selenium compounds in Brit. Pat. No. 1,217,194, alkylamine compounds in Brit. Pat. No. 1,192,481, polyamine compounds in Japanese Pat. Publication No. 8,836/70, and other compounds disclosed in U.S. Pat. Nos. 3,042,520, 3,241,966, 3,983,858, Japanese patent application Laid-Open ("Kokai") Nos. 40,943/74, 59,644/74, 117,037/74, 88,522/74, 42,349/74, 110,327/76, Brit. Pat. No. 926,569, 1,170,973, 1,201,571, and German Pat. No. 1,937,727.

Most of the known accelerators, however, are insufficient in accelerating effect and tend to lose the effectiveness during storage of the treating solution. Others, even though sufficient in effectiveness, have also unsatisfactory properties of some kind or other such as causing undesirable fogging by contaminating other treating solutions (for example, developing bath) as in the case of automatic processing by means of an automatic processing equipment in which contaminants tend to be carried by the belting or the like to other treating baths to contaminate them.

On the other hand, in recent years, there have been ever increasing demands for the color photographic sensitive materials which can be photographically processed more rapidly and demands for those which contain silver halide in an amount as small as possible in order to save silver resources. so-called thinning of emulsion layers, that is, reduction in the thickness of emulsion layers, is advantageous for the rapid processing because of rapid silver removal and for other reasons, but has its own limit. Consequently, several means have heretofore been proposed to meet the above demands. Firstly, couplers of the two equivalent type, particularly two equivalent yellow couplers and two equivalent magenta couplers in recent years, have been commercialized and in actual use. As compared with conventional couplers of the four equivalent type, the two equivalent type allows the amount used of silver halide to be reduced to from two-thirds to one half as well as the photographic processing to be carried out more rapidly, but sometimes accompanies difficulty in silver removal. Secondly, a developing agent of high developing activity such as, for example, 4-amino-3-methyl-N-ethyl-N-methoxyethylaniline or p-aminophenol has been used. In this case, the rapidity of processing depends on the speed of silver removal. Thirdly, where has been proposed a means whereby a color photographic image can be obtained with a sensitive material of extremely low silver halide content by incorporating in the processing procedure an image intensifying operation utilizing complex cobalt salts or peroxides as described in, for example, Japanese patent application Laid-Open ("Kokai") Nos. 9,728/73, 9,729/73, 48,130/73, 64,932/73, 23,634/74, 84,229/74 and 84,239/74. However, in this case also simplification and speed-up of photographic processing encounter a difficulty in the silver removing step.

As described above, the greatest difficulty encountered in exploiting a silver halide color photographic sensitive material suitable for rapid photographic processing exists in silver removal. Although there are a few proposals for improving the silver removability of the color photographic sensitive material itself [for example, Japanese patent application Laid-Open ("Kokai") Nos. 19,750/69, 49,725/76 and 110,327/51], the fact is that most of the current color photographic techniques owe the silver removal to the processing steps, particularly the bleaching or bleachfixing bath containing the aforementioned bleach accelerators or the like. It is not unconceivable that some of the known bleach accelerators might possibly promote the silver removal more effectively when incorporated in at least one layer of the silver halide color photographic sensitive material, preferably in a non-sensitive layer adjacent to the silver halide emulsion layers in order to reduce the photographic influence than when present in a processing bath such as bleaching or bleachfixing bath. However, when directly incorporated in a color photographic sensitive material, many of the compounds commonly called bleach accelerators bring about undesirable fog and such compounds generally affects adversely the photosensitivity of the fresh sensitive material and photographic characteristics (sensitivity, gradation, fog, etc.) of the preserved sensitive material. For these reasons, the inclusion of a bleach accelerator in the sensitive material has heretofore been precluded from actual use. Even if compounds suitable for use as internal bleach accelerators might be found, on careful selection such compounds would be very limited in number until future technical improvement might permit the bleach accelerators to be directly incorporated in the sensitive material.

SUMMARY OF THE INVENTION

The primary object of this invention is to provide a multilayer silver halide color photographic sensitive material suitable for rapid color photographic processing.

Another object of this invention is to provide a multilayer silver halide color photographic sensitive material submissive to rapid silver removal.

A further object of this invention is to provide a multilayer silver halide color photograhic sensitive material improved in rapidity of silver removal and preservability as well as against fogging and desensitization.

A still further object of this invention is to provide a multilayer silver halide color photographic sensitive material improved in hue after color development.

The above-noted objects of this invention can be achieved by incorporating in at least one layer of the multilayer silver halide color photographic sensitive material a salt of at least one compound selected from the group consisting of organic compounds containing sulfur and heterocyclic compounds containing no sulfur with a heavy metal ion.

DESCRIPTION OF THE INVENTION

This invention is based on the idea that the silver removal can be more effectively achieved when a bleach accelerator is incorporated in the color photographic sensitive material than when it is present in a bleaching or bleachfixing bath and that the various defective properties (for example, fog formation) of the bleach accelerator can be eliminated by using it in the form of a salt with a heavy metal ion. The idea has proved successful in achieving the objects of this invention. In view of the above idea, not all of the known bleach accelerators described hereinbefore are deemed suitable for the purposes of this invention. It has been discovered that the compounds in the category of organic compounds containing sulfur and heterocyclic compounds containing no sulfur are especially effective. The concept of "organic compounds containing sulfur and heterocyclic compounds containing no sulfur" includes not only aforementioned known compounds commonly called bleach accelerators but also those compounds which belong to the class of so-called antifoggants or the class of so-called stabilizers. Similarly to the known bleach accelerators such as, for example, mercaptotriazoles and the like, even those antifoggants and stabilizers which can react with silver in the silver halide emulsion, thereby forming salts, are able to exhibit an accelerating effect on silver removal in a greater or lesser degree depending upon the conditions of the silver halide photographic sensitive material (such as, for example, silver ion concentration and pH in the silver halide emulsion) and also to exhibit sufficient effectiveness in achieving other objects of this invention.

A variety of heavy metal ions can be used in forming "salts," as herein specified, by the reaction with the organic compounds containing sulfur or heterocyclic compounds containing no sulfur. The "salts," as herein referred to, include not only simple salts but also complex salts and are entirely different from those salts which are soluble in water or an alkali, such as alkali metal salts of sulfur-containing organic compounds having a carboxylic group or sulfonic acid group (for example, sodium sulfonates).

In achieving the objects of this invention, it is preferable that the "salts" be substantially insoluble in the developing bath but soluble in the silver-removing bath (or baths). The term "substantially insoluble," as herein used, means that the "salts" are completely insoluble in an alkaline developing bath or, even if partially soluble, would not adversely affect the development process (for example, marked fogging or development retarding) and remain in the sensitive material in an amount sufficient for exhibiting accelerator effect on silver removal in the succeeding silver removing step. The term "soluble," as herein used, means that at least effective amounts of the "salts" may dissolve in a bleaching, fixing or bleachfixing bath. Desirable solubility of the salts in terms of organic compounds containing sulfur or heterocyclic compounds containing no sulfur is about $10^{-4}$ g/l or less in an alkaline developing bath and about $10^{-2}$ g/l or more in a bleachfixing bath. Heavy metal ions desirable for the purposes of this invention vary according to the type of organic compounds containing sulfur or heterocyclic compounds containing no sulfur and, hence, cannot be unconditionally specified. Those suitable for the purposes of this invention include ions of iron, cobalt, nickel, copper, zinc, rhodium, palladium, silver, cadmium, iridium, platinum, gold and lead. Of these, ions of colbat, nickel, copper and lead, particularly silver and zinc ions are preferred. The silver ion, as herein referred to, may be in the form of a silver halide, such as chloride, bromide or chlorobromide of silver, which is different from those blue-sensitive, green-sensitive and red-sensitive types of silver halides that are used as major components in the multilayer silver halide color photograhic sensitive material of this invention. The silver halide used for the purposes of this invention has a far lower photosensitivity in the practical exposure range as compared with silver halide of the sensitive type.

A technique has been known for obtaining a high photosensitivity by the combined use of a layer containing substantially non-sensitive silver halide and an emulsion layer containing silver halide as major sensitive component. Such a technique is distinctly different from the present invention in objects and effect.

Examples of the organic compounds containing sulfur and heterocyclic compounds containing no sulfur used in this invention are shown below for the purpose of illustrating preferably types of compounds and not for the purpose of limiting the invention.

Mercaptotriazoles: (1)

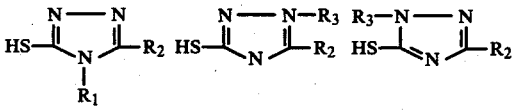

Mercaptothiadiazoles: (2)

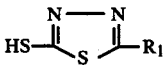

Mercaptoimidazoles: (3)

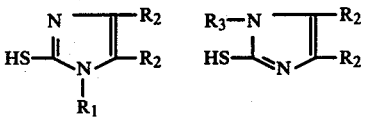

Mercaptoimidazolines: (4)

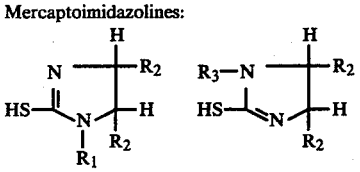

Mercaptotetrazoles: (5)

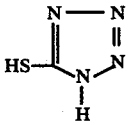

In the above general formulas of mercapto compounds (1) to (4), $R_1$ represents hydrogen atom, an alkyl group, amino group, alkylamino group, acylamide group or aryl group, $R_2$ represents hydrogen atom, an alkyl group, amino group, alkylamino group, alkylmercapto group or halogen atom, and $R_3$ represents hydrogen atom or an alkyl group.

(6) Mercaptopyrimidines (for example, 2-mercapto-4-aminopyrimidine, etc.).

(7) Mercaptopurines (for example, 2-amino-4-mercpatopurine, etc.)

(8) Mercaptoquinolidines (for example, 4-mercapto-4H-quinolidine, etc.)

(9) Compounds of the general formula

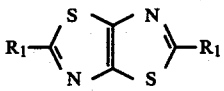

wherein, $R_1$ represents

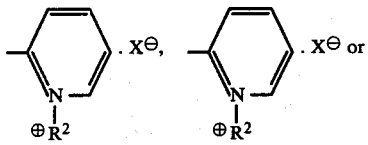

-continued

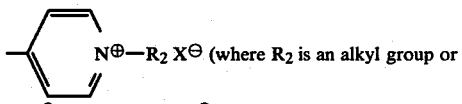

$R_2X^{\ominus}$ is $\leftarrow CH_2\rightarrow_n SO_3^{\ominus}$, n being 3 or 4, and $\ominus$ represents an anion).

(10) Monothioglycerol

(11) Cystine

(12) Cystamine

(13) Cysteine

(14) Aminoalkylene thiols of the general formula

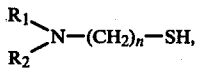

wherein $R_1$ and $R_2$ each represents hydrogen atom, methyl or ethyl group and n represents an integer from 1 to 3. Examples are 2-aminoethanethiol, 3-aminopropanethiol, dimethylaminopropanethiol, and N-methyl-N-ethylaminoethanethiol.

(15) Imidazole compounds of the general formula

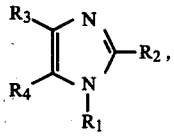

wherein $R_1$ to $R_4$ each represents hydrogen atom, an alkyl group, hydroxyalkyl group or alkenyl group.

(16) Thiourea derivatives of the general formula

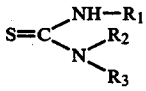

wherein $R_1$ and $R_2$ each represents an alkyl group, hydroxyalkyl group, phenyl group or allyl group, $R_1$ and $R_2$ may jointly form a hereto ring, and $R_3$ represents an alkyl, hydroxyalkyl or allyl group when $R_1$ and $R_2$ do not form a hetero ring and hydrogen atom, an alkyl group or hydroxyalkyl group when $R_1$ and $R_2$ jointly form a hetero ring.

(17) Thioamide compounds of the general formula $R\text{-}CSNH_2$, wherein R represents hydrogen atom or an alkyl group having 1 to 16 carbon atoms. Examples are $HCSNH_2$, $C_2H_5CSNH_2$ and $C_{13}H_{27}CSNH_2$.

Preparation of the salts substantially insoluble in an alkaline developing bath from the above-noted organic compounds containing sulfur or heterocyclic compounds containing no sulfur can be easily performed by reacting these compounds with at least one of the salt compounds of the aforementioned heavy mtals such as metal nitrate. The reaction can be carried out in water or an organic solvent (for example, methanol) and the precipitates are finely dispersed in a solution of a hydrophilic binder such as gelatin or the like, or, alternatively, carried out directly in a hydrophilic binder solution with stirring to form a fine dispersion. The hydrophilic binder solution can be that solution which is to be applied as the hydrophilic binder layers of the multilayer silver halide color photographic sensitive material (for example, silver halide emulsion layers, intermediate layers, protective layer, ultraviolet absorbing layer, etc.) or preferably a small amount of a hydrophilic binder solution prepared separately and to be added to the former binder solution. It can also be that hydrophilic binder solution which is commonly used in the art in preparing a dispersion of a hydrophobic coupler or ultraviolet absorber by using a high-boiling solvent (for example, dibutyl phthalate, tricresyl phosphate or the like) or a polymer latex.

The molar ratio between the organic compounds containing sulfur or hetercyclic compounds containing no sulfur being reacted and the salt compounds of heavy metals being reacted is in the range of from about 1:20 to about 50:1, preferably from about 1:10 to about 20:1, depending on the type of compounds.

The salts according to this invention can be incorporated in any of the component layers of the multilayer silver halide color photographic sensitive material (for example, blue-sensitive, green-sensitive and red-sensitive silver halide emulsion layers, intermediate layers, ultraviolet absorbing layer, subbing layer, anti-halation layer, protective layer, etc.) or in two or more layers.

The amount of the salts according to this invention to be incorporated is generally in the range of from about $10^{-5}$ g/m$^2$ to about 1 g/m$^2$ in terms of organic compounds containing sulfur or heterocyclic compounds containing no sulfur, depending on the type of salt, type of sensitive material, type and position of the layer being incorporated with the salt, type of the bleach bath, etc. If necessary, an amount of the salt outside the above range may, of course, be incorporated.

As has been disclosed in, for example, Japanese Pat. Publication No. 14,501/68 and14,502/68, it is known to incorporate in a photographic sensitive material the same type of salt as herein described. However, such a disclosure concerns with an improvement in a photosensitive copying material, which comprises incorporating in the photosensitive material a salt of a specified mercapto compound with a specified heavy metal to improve hue of the silver image, said photosensitive material being of the activator type containing a large amount of a developing agent and being treated in a strong alkaline solution (activator bath) containing no developing agent. Therefore, such a known technique has not been intended to be applied to a silver halide color photographic sensitive material and, hence, is distinctly different from the present invention in subject matters.

According to this invention, there is provided a multilayer silver halide color photographic sensitive material suitable for rapid color photographic processing, the time required for bleaching or bleachfixing being reduced.

According to this invention, there is provided a multilayer silver halide color photographic sensitive material susceptible to satisfactory silver removal even in a bleachfixing bath containing an iron salt of aminopolycarboxylic acids having a comparatively weak silver removing power.

According to this invention, there is provided a multilayer silver halide color photographic sensitive material capable of reducing the influence due to fatigue of the processing baths in running treatment of the material by means of an automatic processing equipment.

According to this invention, there is provided a multilayer silver halide color photographic sensitive material having stable photographic characteristics without exhibiting the defects inherent in the organic compounds containing sulfur or heterocyclic compounds containing no sulfur.

According to this invention, there is provided a multilayer silver halide color photographic sensitive material improved in hue and having a brilliant color.

According to this invention, there is provided a multilayer silver halide color photographic material susceptible to satisfactory silver removal even when the silver is in a condition difficult for removal such as in the undermost silver halide emulsion layer (the one nearest the support) or in a silver halide emulsion layer containing silver iodide.

The multilayer color photographic sensitive material of this invention contains as constitutive layers silver halide emulsion layers, particularly each at least one red-sensitive layer, green-sensitive layer and blue-sensitive layer.

The silver halides used in the above silver halide emulsions include those used in common silver halide photographic emulsions, such as silver bromide, silver chlorobromide, silver iodobromide, silver chloroiodobromide, and silver chloride. The formation, dispersion and physical ripening of the above-noted silver halides can be carried out by various known procedures under known conditions. Examples of advantageous procedures include normal mixing, reversed mixing, simultaneous mixing, halogen conversion (Japanese Pat. Publication No. 7,772,/71; U.S. Pat. No. 2,592,250), ammonia method, acidic or neutral method, alkali method, ethylenediamine method (U.S. Pat.. No. 2,448,534), silver iodide nucelus method [Japanese patent application Laid-Open ("Kokai") No. 65,925/73], and various combination methods. After physical ripening, the silver halide emulsion can be used as such or preferably after having been freed from soluble salts.

The hydrophilic binders suitable for use in preparing the photosensitive emulsions of the present multilayer silver halide color photographic sensitive material are lime-treated gelatin, acid-treated gelatin; gelatin derivatives described in U.S. Pat. Nos. 2,594,293, 2,614,928, 2,763,639, 3,118,766, 3,132,945, 3,186,846, 3,312,53, Brit. Pat. No. 861,414 and 1,033,189, Japanese Pat. Publication No. 5,514/64 and 26,845/67; casein, colloidal albumin, cellulose derivatives such as carboxymethylcellulose and hydroxyethylcellulose; agar, gum arabic; alginic acid and its derivatives such as esters and amides; saccharide derivatives; synthetic polymer binders such as polyvinyl alcohol and poly(N-vinylpyrolidone).

These hydrophilic binders are advantageously used also in preparing the photographic material constituting layers containing no silver halide (except for low-sensitivity silver halide previously referred to) such as, for example, intermediate layers, protective layers, ultraviolet absorbing layer, etc.

The silver halide emulsion for use in this invention is preferably sensitized with various chemical sensitizers. The sensitizers include activated gelatin; sulfur sensitizer, selenium sensitizers such as N,N-dimethylselenourea and selenourea, reduction sensitizers such as triethylenetetramine and stannic chloride described in U.S. Pat. Nos. 1,574,994, 1,623,499, 2,410,689, 3,189,458, and 3,501,313; gold sensitizer described in U.S. Pat. Nos. 2,399,083, 2,540,083, 2,597,856 and 2,597,916; and noble metal sensitizers such as palladium, iridium, rhodium, ruthenium and platinum. These sensitizers are used each alone or in suitable combinations. patent application patent The blue-sensitive, green-sensitive and red-sensitive emulsions for use in the multilayer silver halide color photographic sensitive material of this invention are optically sensitized with suitable sensitizing dyes to render the emulsions sensitive to light rays in the desired wave-length range. The sensitizing dyes include methine and styryl dyes such as cyanine, merocyanine, hemicyanine, rhodacyanine, oxonol and hemioxonol. These sensitizing dyes are used each alone or in combinations of two or more. Examples are red sensitizing dyes described in Japanese Pat. Publication Nos. 4,938/68 and 42,974/73; Japanese Pat. Application Laid-Open ("Kokai") Nos. 106,322/74, 111,629/74, and 56,426/73; green sensitizing dyes described in Japanese Pat. Publication Nos. 549/71 and 40,662/75, Japanese Pat. application Laid-Open ("Kokai") Nos. 26,126/72, 33,817/73, 41,733/73, and 59,828/73, U.S. Pat. No. 2,177,402; blue sensitizing dyes described in Japanese Pat. Publication Nos. 19,034/70, 30,023/71, and 37,538/75, Japanese patent application Laid-Open ("Kokai") No. 1,630/71, and U.S. Pat. No. 3,752,670.

The multilayer silver halide color photographic sensitive material of this invention may contain a coupler for forming dye image. Useful couplers include open-chain ketomethylene yellow couplers of the pivaloylacetanilide or benzoylacetanilide type, magenta couplers of the pyrazolone type, pyrazolotriazole type, pyrazolinobenzimidazole type and imidazolone type and cyan couplers of the phenol type or naphthol type. It is also possible to use these couplers in combination with azo-type colored couplers for automasking, osazone-type compounds, development diffusing dye releasing couplers and development inhibitor releasing couplers.

The present invention is advantageously adaptable to a color photographic sensitive material, such as a multilayer color photographic sensitive material disclosed in Japanese Pat. Publication No. 7,334/77, which utilizes at least one coupler, called two equivalents coupler, bearing at the active site a substituent group such as —O-aryl, —O-acyl, hydantoin compound, urazol compound, succinimide compound, monoxoimide compound, pyridazone compound, fluorine, chlorine, bromine or —O-sulfonyl. Examples of such couplers are yellow, magenta and cyan couplers described in U.S. Pat. Nos. 2,376,679, 2,991,177, and 3,021,215, Japanese patent application Laid-Open ("Kokai") Nos. 30,933/73, 43,938/73, 66,836/73, 42,345/74 and 9,449/76, yellow couplers described in U.S. Pat. Nos. 2,875,057, 3,408,194, 3,644,498, 3,933,501, and 3,265,506, Japanese patent application Laid-Open ("Kokai") Nos. 66,834/73, 66,835/73, 73,147/73, 37,423/72, 87,650/75, and 123,342/75, Japanese Pat. Publication No. 33,773/75, magenta couplers described in Japanese Pat. Publication No. 16,187/68, Japanese patent application Laid-Open ("Kokai") Nos. 11,331/74 and 3,630/75, and cyan couplers described in Japanese patent Laid-Open ("Kokai") Nos. 4,430/72, 24,024/72, and 42,732/73, U.S. Pat. Nos. 2,423,730, 2,801,171, 2,895,826 and 3,880,661.

The couplers can be incorporated in the silver halide color photographic sensitive material of this invention by applying customary techniques. For instance, couplers can be incorporated by dissolving in a high-boiling solvent and dispersing the resulting solution in the form of fine liquid particles in the intended layer. It is also desirable to use a low-boiling solvent jointly with the high-boiling solvent. Suitable high-boiling solvents are carboxylate esters, phosphate esters, carboxylic acid amides, ethers, and substituted hydrocarbons. Examples of water-immiscible high-boiling solvents include di-n-butyl phthalate, diisooctyl phthalate, diisodecyl phthalate, dimethoxyethyl phthalate, di-n-butyl adipate, triphenyl phosphate, tricresyl phosphate, diethyllaurylamide, dibutyllaurylamide, benzyl phthalate, tributyl phosphate, N,N-diethylcapramide, triisooctyl phosphate, phenoxyethanol, diethylene glycol monophenyl ether, hexamethylphosphoramide, monophenyl p-tert-butylphenyl phospate, succinate esters, and maleate esters. Examples of the low-boiling solvents include ethyl acetate, butyl acetate, dimethylformamide, dimethyl sulfoxide, cyclohexane, methyl isobutyl ketone, β-ethoxethyl acetate, methoxytriglycol acetate, acetone, methylacetone, methanol, ethanol, acetonitrile, dioxane, isopropyl acetate, butanol, cyclohexanol, fluoroalcohols and methyl-Cellosolve. The low-boiling solvent is used in place of or together with a high-boiling solvent. The solvents can be used each alone or in combinations.

Preparation of a dispersion of a hydrophobic coupler by use of a high-boiling solvent is generally carried out by dissolving the coupler in the high-boiling solvent admixed with, if necessary, a low-boiling solvent, mixing the resulting solution with an aqueous gelatin solution containing a surface active agent, and emulsifying by means of an emulsifying equipment such as colloid mill or homogenizer to obtain a dispersion. It is also possible to use a water-soluble coupler as a Fischer-type solution prepared by dissolving the coupler in an alkaline solution. Incorporation of a coupler into a hydrophilic binder can be advantageously accomplished by a method utilizing a polymer latex as described in U.S. Pat. Nos. 2,772,163, 3,619,195, 2,852,382, and 2,269,158, and Japanese Pat. Publication No. 39,853/76.

The multilayer silver halide color photographic sensitive material of this invention does not necessarily contain a coupler but the dye image can be produced by so-called coupler-in-developer-type color development using a color developing solution containing a coupler. Further, the novel technique of this invention is applicable to a silver halide color photographic sensitive material of the silver dye bleaching process requiring no coupler.

The multilayer silver halide color photographic sensitive material of this invention may contain various common photographic additives in its silver halide emulsion layers or auxiliary layers. Examples of hardeners are aldehydes such as formaldehyde and glutaraldehyde, ketones such as diacetyl and cyclopentadione; reactive halogen-containing compounds such as bis(2-chloroethylurea), 2-hydroxy-4,6-dichloro-1,3,5-triazine and compounds described in U.S. Pat. Nos. 3,288,775 and 2,732,303, Brit. Pat. Nos. 974,723 and 1,167,207; reactive olefines such as divinyl sulfone, 5-acetyl-1,3-diacryloylhexahydro-1,3,5-triazine and compounds described in U.S. Pat. Nos. 3,232,763 and 3,635,718, Brit. Pat. No. 994,869; N-methylol compounds such as N-hydroxymethylphthalimide and compounds described in U.S. Pat. Nos. 2,732,316 and 2,586,168; isocyanates described in U.S. Pat. No. 3,103,437; aziridine compounds described in U.S. Pat. Nos. 2,950,197, 2,964,404, 2,983,611 and 3,017,280; acid derivatives described in U.S. Pat. Nos. 2,725,294 and 2,725,295; and carbodiimides described in U.S. Pat. No. 3,100,704; epoxy compounds described in U.S. Pat. No. 3,091,537; isooxazoles described in U.S. Pat. Nos. 3,321,313 and 3,543,292; halogencarboxyaldehydes such as mucochloric acid; dioxane derivatives such as dihdroxydioxane and dichlorodioxane; inorganic hardeners such as chrome alum and zirconium sulfate. Examples of gradation regulators are VIII group metals (for example, rhodium and ruthenium), cadmium, thallium, etc. Benzyl alcohol and polyoxyethylene compounds are used as development accelerator. These compounds are also effective when present in processing bath. Examples of antifoggants, stabilizers and silver halide crystal habit regulators are described in U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,476,536, 2,566,245, 2,694,716, 2,697,099, 2,708,162, 2,728,663, 2,728,664, 2,728,665, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, 3,662,339, 3,573,056, Brit. Pat. Nos. 893,428, 403,789, 1,173,609, and 1,200,188. Examples of ultraviolet absorbers are found in U.S. Pat. Nos. 2,632,701, 2,685,512, 2,739,888, 2,747,996, 2,784,087, 3,253,921, 3,352,681, 3,533,794, 3,738,837, 3,754,919, 3,769,294, Brit. Pat. No. 1,026,142 and Japanese Pat. Publication No. 26,139/74. Examples of antioxidants are described in U.S. Pat. Nos. 2,360,290, 3,432,300, 3,573,050, 3,574,627, 3,698,909, and 3,764,337; Ger. Pat. Application Laid-Open No. 2,146,668; Japanese Pat. Publication Nos. 31,256/73, 31,625/73, 31,626/73, 20,973/74, 20,974/74, and 30,462/76, Japanese patent application Laid-Open ("Kokai") Nos. 37,635/72, 26,133/73, 134,326/74, 6,338/75, and 6,339/75. Examples of scavengers are described in U.S. Pat. Nos. 2,336,327, 2,356,486, 2,360,290, 2,401,713, 2,403,721, 2,675,314, 2,701,197, 2,704,713, 2,710,801, 2,728,659, 2,732,300, 2,735,765, 2,816,028, 2,998,314, 3,174,862, 3,178,286, 3,180,734, 3,384,486, and 3,700,453; Japanese Pat. Publication No. 14,033/70, 23,813/75; Japanese patent application Laid-Open ("Kokai") No. 83,031/75 and 156,438/75. Examples of surface active agents are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, Brit. Pat. Nos. 1,077,317, and 1,198,450; Japanese Pat. Publication Nos. 9,303/72 and 43,130/73; Ger. Pat. Application Laid Open No. 1,961,638.

Other additives include fluorescent whiteners such as those described in Japanese Pat. Publication No. 7,127/59; lubricants such as wax, glycerides of higher fatty acids, and higher alcohol esters of higher fatty acids; sequestering agents such as ethylenediaminetetraacetic acid; mordants such as N-guanylhydrazone compounds, quaternary onium chlorides and tertiary amines; antistatic agents such as diacetylcellulose, styrene-perfluoroalkylene-sodium maleate copolymer, and sodium salt of reaction product of styrene-maleic anhydride copolyer and p-aminobenzenesulfonic acid; silver removal accelerators such as aforementioned bleach accelerators which may be added if necessary; matting agents such as polymethyl methacrylate, polystyrene, methacrylic acid-methyl methacrylate copolymer, colloidal silica, and the like; agents for improving physical properties of coatings such as a latex comprising copolymers of an acrylate ester or vinyl ester with other ethyleneically unsaturated monomers, plasticizers for gelatin such as those described in Japanese Pat. Publication No. 4,939/68; and thickeners such as styrene-maleic acid copolymers and alkyl vinyl ether-maleic acid copolymers.

The multilayer silver halide color photographic sensitive material of this invention is prepared by applying onto a support silver halide emulsion layers and other constitutive layers containing, if necessary, suitable photographic additives mentioned above. Examples of suitable supports are baryta paper, polyethylene coated paper, synthetic paper such as polypropylene paper, plate glass, cellulose acetate flm, cellulose nitrate film, polyvinylacetal film, polyester film such as polyethylene terephthalate, polyamide film, polycarbonate film and polystyrene film. These supports are properly selected according to the intended use of the multilayer silver halide color photographic sensitive material. If necessary, the support is applied with subbing. It is also possible to treat the support surface by corona discharge, glow discharge or other electronic impact, flaming, roughening, and ultraviolet irradiation.

After exposure, the multilayer silver halide color photographic sensitive material of this invention can be color developed by a common color development process. Reversal development is carried out by first developing in a developer solution for monochrome negatives, then exposing to white light or treating in a bath containing a fogging agent, and thereafter color developing in an alkaline developer solution containing color developing agent. Suitable color developing agents are N,N-disubstituted pphenylenediamine such as, for example, N,N-diethyl-p-phenylenediamine, N-ethyl-N-(β-hydroxyethyl)-p-phenylenediamine, 4-amino-N-ethyl-N-(β-methanesulfonamidoethyl)-m-toluidine, 4-amino-N-ethyl-N-(β-hydroxyethyl)-m-toluidine, 4-amino-N-ethyl-N-(β-methoxyethyl)-m-toluidine, 4-amino-N-ethyl-N-(β-ethoxyethyl)-m-toluidine, 4-amino-N-ethyl-N-[β-(β-ethoxy)ethoxyethyl]-m-toluidine, and salts of these amines with organic or inorganic acids.

The developed material can be treated by any known procedure without any particular restriction. In one of the typical processes, as described in U.S. Pat. No. 3,582,322, the material, after color development, is treated in a bleachfixing bath, then, if necessary, washed with water and stabilized. In another process such as described in U.S. Pat. No. 910,002, the sensitive material, after color development, is treated successively in bleaching bath and fixing bath.

It is also possible, as mentioned above, to treat a low silver content sensitive material with an intensifying agent such as a complex cobalt salt or hydrogen peroxide. Such treatment can be rapidly carried out at a temperature of about 30° to 60° C. or even higher. The treatment can be carried out also at room temperature or, in special cases, at a temperature below room temperature. Before the treatment at high temperatures, the material can be treated in a prehardening bath. Suitable bleaching agents are bichromate salts, red prussiates, permanganate salts, iron oxide, halogen, persulfuric acid, metal salts of aminopolycarboxylic acid (for example, complex iron salt of ethylenediaminetetraacetic acid and iron salt of nitrirotriacetic acid), tartarates; cobalt salts described in Germ. Pat. No. 954,475 and Brit. Pat. No. 777,635; quinone type bleaching agents described in U.S. pat. No. 2,507,183 and 2,529,981; nitroso compounds described in, for example, U.S. Pat. No. 2,705,201; complex copper salts described in Brit. Pat. Nos. 774,194, 1,032,024, and Japanese Pat. Publication No. 1,478/60; and halogen acid compounds described in U.S. Pat. No. 3,264,107 and Japanese Pat. Publication No. 11,068/66. Suitable fixing agents are thiosulfates, thiocyanates; thio ether polycarboxylic acids described in U.S. Pat. No. 2,748,000; and bisulfonylalkanes described in Japanese patent application Laid-Open ("Kokai") No. 330/72. If necessary, aforementioned various bleach accelerators can be used to promote effectively the bleaching or bleachfixing.

Other auxiliary chemicals used in this invention are phosphoric acid, acetic acid, citric acid, tartaric acid, boric acid, and alkali metal salts or ammonium salts of these acids.

The invention is illustrated below with reference to Examples, but the invention is not limited thereto.

EXAMPLE 1

To a mixture of 140 ml of a 10% aqueous solution of alkali-treated gelatin and 15 ml of a 5% aqueous solution of sodium dodecylbenzenesulfonate, was added 8 g of a yellow coupler (a) of the formula

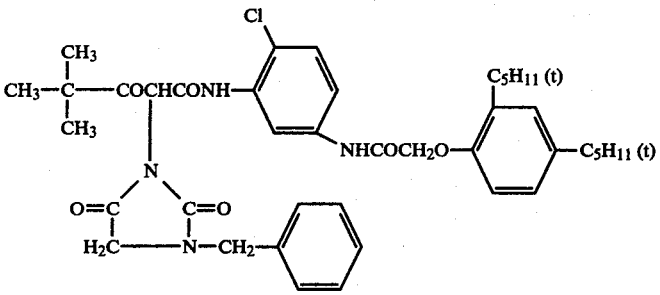

(a)

dissolved in 4 ml of di-n-butyl phthalate and 24 ml of ethyl acetate. The mixture was treated by means of a dispersing apparatus to obtain a coupler dispersion.

On the other hand, a solution prepared by mixing 40 g of silver nitrate, 120 ml of water and 40 ml of a 28% aqueous ammonia was added to 800 ml of a 2.5% aqueous solution of alkali-treated gelatin. To the resulting mixture, while being maintained at 40° C., was added a solution prepared by adding 0.4 ml of 0.05% potassium hexachloroiridate (IV) solution to a solution comprising 30 g of potassium bromide, 2 g of potassium chloride and 100 ml of water. The resulting emulsion was allowed to ripen.

The above emulsion was adjusted to pH 4.0 then cooled to 30° C., precipitated, dehydrated and washed to remove soluble salts until a desired electric conductivity was reached. A portion of the emulsion corresponding to 9.6 g of silver nitrate was weighed out ad dispersed in 240 ml of a 4% aqueous solution of alkali-treated gelatin. After having been adjusted to pH 6.5, the emulsion was subjected to chemical ripening at 55° C. After having been cooled to 35° C., to the emulsion was added 9.6 ml of a 0.1% N,N-dimethylformamide solution of a blue-sensitizing dye (b) of the formula

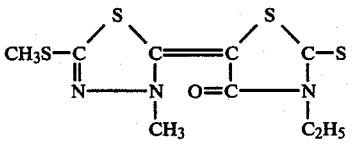

(b)

followed by the coupler dispersion obtained before and then by a hardener (N,N',N''-trisacryloyl-1,3,5-hexahydrotriazine). The emulsion was adjusted to pH 6.4 and admixed with 2 g of gelatin and water to make the total to 800 g. The blue-sensitive emulsion (reference emulsion A) thus obtained and a gelatin solution for protective layer were applied one over the other onto a sheet of polyethylene-laminated photographic paper, the coverage of the emulsion layer having been 50 g/m$^2$ (wet basis) (reference specimen A).

Preparation of "salt": Each 5 mg of the sulfur-containing organic compounds shown in Table 1 and an equivalent amount of a nitric acid solution of metal shown in Table 1 were added to each 50 ml of an aqueous solution containing 2 g of gelatin. The mixture was quickly stirred to form a fine dispersion of the salt.

Table 1

| Salt No. | Compound | Metal |
|---|---|---|
| 1 | 3-Mercapto-1,2,4-triazole | Silver |
| 2 | 4-Amino-3-mercapto-1,2,4-triazole | " |
| 3 | 2-Mercapto-5-amino-thia-3,4-diazole | " |
| 4 | 2-Mercaptoimidazole | " |
| 5 | 5-Mercaptotetrazole | " |
| 6 | 3-Mercapto-1,2,4-triazole | Zinc |
| 7 | 4-Amino-3-mercapto-1,2,4-triazole | " |

The specimens 1 to 7 according to this invention were prepared in the same manner as mentioned before, except that the salt dispersion was used in place of 2 g of gelatin and water added to prepare 800 g of the reference emulsion (A). Another reference specimen (B) was prepared by using 5 mg of 3-mercapto-1,2,4-triazole in place of its metal salt. After having been kept at 35° C. for 2 days, the specimens were thoroughly fogged by exposing to white light and then color developed (30° C., 4 minutes). Bleachfixing was carried out at 30° C. for 1, 2, 3 and 4 minutes to measure the retained amount of silver by fluorescence X-rays analysis.

Formulations of processing baths were as follows:

| | | |
|---|---|---|
| Color developing bath: | | |
| Sodium hydroxide | 1.7 | g |
| Sodium metaborate | 50 | g |
| Anhydrous sodium sulfite | 1.8 | g |
| Potassium bromide | 0.5 | g |
| CD-III | 4.4 | g |
| Sodium hexametaphosphate | 0.5 | g |
| Hydroxylamine hydrochloride | 1.0 | g |
| Benzyl alcohol | 1.2 | ml |
| Ethylene glycol | 10 | ml |
| Water to | 1 | liter |
| Bleachfix bath: | | |
| Complex ferric salt of EDTA | 56 | g |
| Disodium salt of EDTA | 2 | g |
| Ammonium thiosulfate | 60 | g |
| Anhydrous sodium sulfite | 20 | g |
| Sodium hydrogen sulfite | 5 | g |
| Disodium phospate | 12 | g |
| Water to | 1 | liter |
| Stabilizing bath: | | |
| Fluorescent whitener | 0.5 | g |
| Potassium alum | 20 | g |

-continued

| | | |
|---|---|---|
| Anhydrous sodium acetate | 5 | g |
| Sodium hydrogen sulfite | 10 | g |
| 36% Formalin | 10 | ml |
| Water to | 1 | liter |

Table 2

| Specimen No. | | of bleachfixing, minute 0 | 1 | 2 | 3 | 4 |
|---|---|---|---|---|---|---|
| Reference specimen | A | 100 | 35 | 12 | 5.5 | 1.7 |
| | B | 100 | 26 | 6.7 | 1.5 | 0.8 |
| 1 | | 100 | 22 | 5.8 | 1.3 | 0.6 |
| 2 | | 100 | 20 | 5.5 | 1.2 | 0.5 |
| 3 | | 100 | 21 | 5.6 | 1.3 | 0.6 |
| 4 | | 100 | 23 | 6.1 | 1.4 | 0.7 |
| 5 | | 100 | 23 | 6.0 | 1.3 | 0.6 |
| 6 | | 100 | 23 | 5.9 | 1.4 | 0.6 |
| 7 | | 100 | 20 | 5.6 | 1.3 | 0.5 |

The results obtained were as shown in Table 2. The amount of retained silver was expressed in percent by taking the amount (600 mg Ag/m$^2$) before bleachfixing as 100%.

It is seen from Table 2 that by using the metal salt, as herein specified, a remarkable improvement in silver removal was achieved.

On the other hand, the specimens were sensimetrically exposed (blue rays) and treated in the same manner as described above, except that the time of bleachfixing was 4 minutes. The photographic characteristics obtained were as shown in Table 3. The sensitivity value in Table 3 is a relative value obtained by assuming the sensitivity of reference specimen A as 100.

Table 3

| Specimen No. | | Relative sensitivity | Fog (yellow) |
|---|---|---|---|
| Reference specimen | A | 100 | 0.05 |
| | B | 72 | 0.27 |
| 1 | | 98 | 0.06 |
| 2 | | 98 | 0.07 |
| 3 | | 98 | 0.07 |
| 4 | | 96 | 0.05 |
| 5 | | 97 | 0.05 |
| 6 | | 90 | 0.07 |
| 7 | | 90 | 0.07 |

It is seen from Table 3 that although improved in silver remmovability, the reference specimen B suffered from marked formation of fog and marked decrease in sensitivity. To the contrary, in the case of the color photographic sensitive material of this invention, fogging tendency is strongly suppressed and the decrease in sensitivity was very small. Similar results were obtained after the specimens had been stored for a long period of time.

EXAMPLE 2

In a manner similar to that in Example 1, a blue-sensitive color photographic material was prepared by using a silver iodobromide emulsion containing 1 mole-% of silver iodide. The protective layer was applied at a coverage of 1 g gelatin/m$^2$ (reference specimen C). The protective layers of the specimens 8 to 24 were incorporated with each 3 mg/m$^2$ (in terms of organic compound containing sulfur or heterocyclic compound containing no sulfur) of the salts shown in Table 4 which were prepared as in Example 1. The salt incorporated in specimen 15 was prepared in the following way: A silver nitrate solution and a potassium bromide solution were mixed in an aqueous gelatin solution at room temperature and the precipitated unsensitized fine grains of silver bromide, which have undergone neither physical ripening nor chemical ripening, were reacted with 4-amino-3-mercapto-1,2,4-triazole to adsorb the salt which were formed by the reaction. It is, of course, possible to form the salt simultaneously with precipitation of silver bromide in the presence of said triazole compound. The protective layer of the reference specimen D contained no salt but only 4-amino-3-mercapto-1,2,4-triazole.

Table 4

| Salt No. | Organic compound | Metal |
|---|---|---|
| 8 | 4-Amino-3-mercapto-1,2,4-triazole | Silver |
| 9 | " | Zinc |
| 10 | " | Cobalt |
| 11 | " | Nickel |
| 12 | " | Lead |
| 13 | " | Cadmium |
| 14 | " | Copper |
| 15 | " | Silver bromide |
| 16 | 2-Methylimidazole | Silver |
| 17 | N-Allylthiourea | " |
| 18 | Cystine | " |
| 19 | 3-Mercapto-4-benzoylamino-5-phenyl-1,2,4-triazole | " |
| 20 | 5-Chlorobenzotriazole | " |
| 21 | 3-Mercapto-4-phenyl-5-amino-1,2,4-triazole | " |
| 22 | 2-Mercapto-4-aminopyrimidine | " |
| 23 | 2-Phenyl-4-carboxy-1,3-thiazolidine (potassium salt) | " |
| 24 | 4-Amino-3-mercapto-1,2,4-triazole + 5-mercaptoterazole (1:1 in weight ratio) | " |

The specimens were treated in the same manner as in Example 1 and the time of completion of bleachfixing and photographic characteristics were examined. The time of completion of bleachfixing, as herein referred to, is the time required until the amount of retained silver became 10 mg/m$^2$ or less, the time interval between measurements having been 30 seconds. The results obtained were as shown in Table 5.

Table 5

| Specimen No. | | Time of completion of bleachfixing | Fog | Specimen No. | Time of completion of bleachfixing | Fog |
|---|---|---|---|---|---|---|
| Reference specimen | C | 5 min. | 0.14 | 15 | 4 min. | 0.06 |
| | D | 3 min. | 0.31 | 16 | 3 min. | 0.04 |
| 8 | | " | 0.04 | 17 | " | 0.07 |
| 9 | | " | 0.04 | 18 | " | 0.03 |
| 10 | | " | 0.05 | 19 | 3 min. 30 sec. | 0.04 |
| 11 | | " | 0.05 | 20 | 4 min. | 0.04 |
| 12 | | " | 0.05 | 21 | 3 min. | 0.05 |
| 13 | | " | 0.04 | 22 | " | 0.04 |
| 14 | | " | 0.05 | 23 | 4 min. | 0.04 |
| | | | | 24 | 3 min. | 0.04 |

It is seen from Table 5 that in the specimens prepared according to this invention, the fog (yellow) formation was reduced to a great extent and the silver removal was improved. No influence of the salt was observed with respect to photographic characteristics such as sensitivity and gradation.

The above results were obtained with the salts of organic compounds and metals in equimolar ratio. Similar results were obtained when the molar ratio of metal to organic compound was varied between 1:0.2 and 1:5.

EXAMPLE 3

In a manner similar to that in the preceding Examples, a green-sensitive silver chlorobromide emulsion was prepared by using a coupler solution prepared by dissolving 8 g of a magenta coupler (c) of the formula

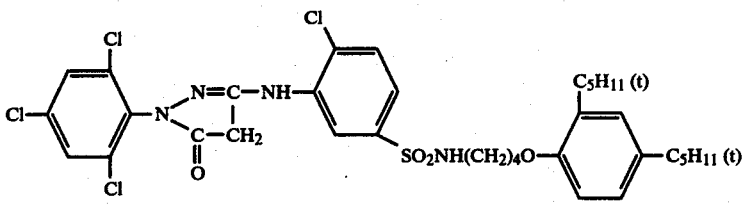

(c)

in a mixture of 16 ml of ethyl acetate and 8 ml of dibutyl phthalate, and using 9.6 ml of a 0.1% N,N-dimethyloformamide solution of a green-sensitizing dye (d) [in place of the blue-sensitizing dye (b)] of the formula

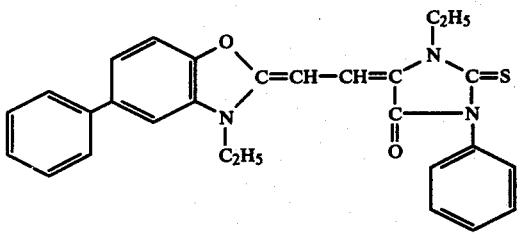

(d)

In a similar manner to that described above, a red-sensitive silver chlorobromide emulsion was prepared by using a coupler solution prepared by dissolving 4.8 g of a cyan coupler (e) of the formula

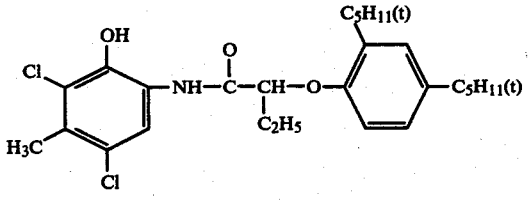

(e)

in a mixture of 9.6 ml of ethyl acetate and 9 ml of dibutyl phthalate, and using 9.6 ml of a 0.1% N,N-dimethylformamide solution of a red-sensitizing dye (f) of the formula

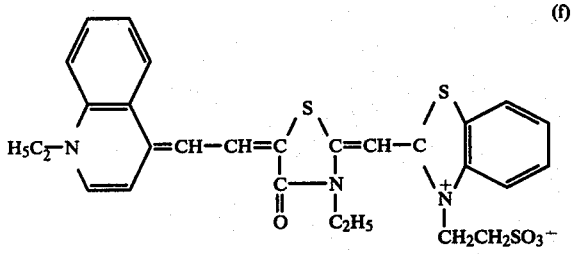

(f)

Using the emulsions thus prepared, the specimens C (reference), 8 and 9 of Example 2 were applied on the protective layer with emulsion coatings and other coatings in the following sequence: green-sensitive emulsion layer, ultraviolet absorbing layer, red-sensitive emulsion layer, and protective layer. After drying, three kinds of specimens of multilayer color photographic sensitive materials were obtained and designated as reference specimen E, specimen 24 and specimen 25, respectively. Further, specimens 26 and 27 were prepared by incorporating the salts in the ultraviolet absorbing layer over the green-sensitive emulsion layer of the specimens 24 and 25, respectively, the incorporated salts being the same as contained in the specimens 24 and 25, respectively.

The time required for completion of bleach fixing was measured on the 5 specimens in the same way as in Example 2, except that the measurement was made every 15 seconds after one minute from the beginning of bleach fixing. The results obtained were as shown in Table 6.

Table 6

| Specimen No. | Reference specimen E | 24 | 25 | 26 | 27 |
|---|---|---|---|---|---|
| Time for completion of bleach: | 6 min. | 3 min. | 3 min. | 3 min. | 3 min. |
| fixing | 30 sec. | 45 sec. | 45 sec. | 15 sec. | 15 sec. |

As is seen from Table 6, according to this invention there were obtained multilayer silver halide color photographic sensitive materials which permit of marked curtailment of time required for silver removal and which show a brilliant color of improved hue. No adverse effect was observed on photographic characteristics such as fog, sensitivity and gradation.

What is claimed is:

1. In a multilayer silver halide color photographic sensitive material to be bleached and fixed or to be subjected to one bath bleaching and fixing treatment after color developing step, the improvement characterized in that said material has in a support and on a support blue-sensitive, green-sensitive and red-sensitive silver halide emulsion layers and in at least one photographic layer a salt with a heavy metal ion of at least one compound selected from the group consisting of (1) mercaptotriazoles,
(2) mercaptothiadiazoles,
(3) mercaptoimidazoles,
(4) mercaptoimidazolines,
(5) mercaptotetrazoles,
(6) mercaptopynimidines,
(7) mercaptopurines,
(8) mercaptoquinolidines,
(9) compounds of the general formula

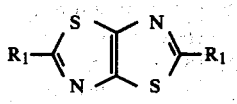

wherein, $R_1$ represents

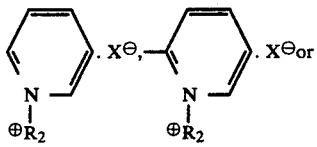

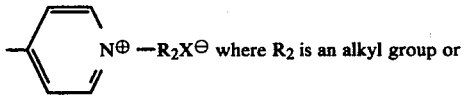

$R_2X^{\ominus}$ is $-(CH_2)_n-SO_3^{\ominus}$, n being 3 or 4, and $\ominus$ is an anion;

(10) monothioglycerol,
(11) cystine,
(12) cystamine,
(13) cysteine,
(14) aminoalkylene thiols of the general formula

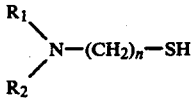

wherein $R_1$ and $R_2$ each represents hydrogen atom, methyl or ethyl group and n represents an integer from 1 to 3,

(15) thiourea derivatives of the general formula

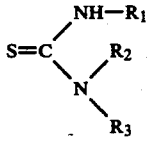

wherein $R_1$ and $R_2$ each represents an an alkyl group, hydroxyalkyl group, phenyl group or allyl group, $R_1$ and $R_2$ may jointly form a hetero ring, and $R_3$ represents an alkyl, hydroxylalkyl or allyl group when $R_1$ and $R_2$ do not form a hetero ring and an alkyl group or hydroxyalkyl group when $R_1$ and $R_2$ jointly form a hetero ring;

(16) thioamide compounds of the general formula $R\text{-}CSNH_2$, wherein R represents hydrogen atom or an alkyl group having 1 to 16 carbon atoms; and

(17) imidazole compounds having the general formula:

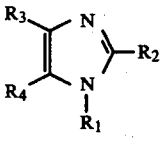

wherein $R_1$-$R_4$ each represents hydrogen atom, an alkyl group, a hydroxylalkyl group or an alkenyl group, and

(18) thiazolidines.

2. A multilayer silver halide color photographic material according to claim 1, wherein the salt is substantially insoluble in an alkaline developing bath and soluble in silver removing bath (baths).

3. A multilayer silver halide color photographic material according to claim 1, wherein the heavy metal ion is an ion of iron, cobalt, nickel, copper, zinc, rhodium, palladium, silver, cadmium, ieidium, platinum, gold or lead.

4. A multilayer silver halide color photographic material according to claim 3, wherein the heavy metal ion is an ion of a metal selected from the group consisting of silver, zinc, cobalt, nickel, copper and lead.

5. A multilayer silver halide color photographic material according to claim 1, wherein the organic compounds containing sulfur is selected from the following compounds:

Mercaptotriazoles: (1)

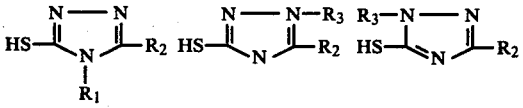

Mercaptothiadiazoles: (2)

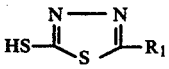

Mercaptoimidazoles: (3)

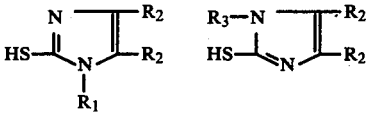

Mercaptoimidazolines: (4)

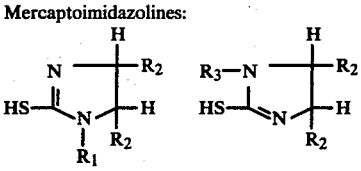

Mercaptotetrazoles: (5)

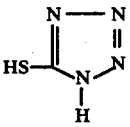

In the above general formulas of mercapto compounds (1) to (4), $R_1$ represents hydrogen atom, an alkyl group, amino group, alkylamino group, acylamide group or aryl group, $R_2$ represents hydrogen atom, an alkyl group, amino group, alkylamino group, alkylmercapto group or halogen atom, and $R_3$ represents hydrogen atom or an alkyl group;

(6) Mercaptopyrimidines,
(7) Mercaptopurines,
(8) Mercaptoquinolidines,
(9) Compounds of the general formula

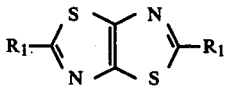

(10) Monothioglycerol,
(11) Cystine,
(12) Cystamine,

(13) Cysteine,

(14) Aminoalkylene thiols of the general formula

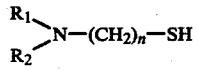

wherein $R_1$ and $R_2$ each represents hydrogen atom, methyl or ethyl group and n represents an integer from 1 to 3,

(15) Thiourea derivatives of the general formula

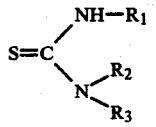

wherein $R_1$ and $R_2$ each represents an alkyl group, hydroxyalkyl group, phenyl group or allyl group, $R_1$ and $R_2$ may jointly form a hetero ring, and $R_3$ represents an alkyl, hydroxyalkyl or allyl group when $R_1$ and $R_2$ do not form a hetero ring and an alkyl group or hydroxyalkyl group when $R_1$ and $R_2$ jointly form a hetero ring, and

(16) Thioamide compounds of the general formula $R\text{-}CSNH_2$, wherein R represents hydrogen atom or an alkyl group having 1 to 16 carbon atoms.

6. A multilayer silver halide color photographic material according to claim 1, wherein the heterocyclic compound containing no sulfur is selected from the imidazole compounds having the general formula:

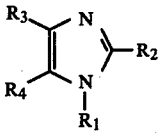

(wherein $R_1$–$R_4$ each represents hydrogen atom, an alkyl group, a hydroxyalkyl group or an alkenyl group).

7. A multilayer silver halide color photographic material according to claim 1, wherein the amount of the salt is $10^{-5}$ g/m$^2$ to 1 g/m$^2$ in terms of organic compound containing sulfur or heterocyclic compound containing no sulfur.

8. A multilayer silver halide color photographic material according to claim 1 wherein at least one of the layers contains a color coupler.

* * * * *